US005386854A

United States Patent [19]

Hacker

[11] Patent Number: 5,386,854

[45] Date of Patent: Feb. 7, 1995

[54] COMPACT JACQUARD TYPE SEAM-WEAVING MACHINE

[75] Inventor: Hans E. Hacker, Reutlingen, Germany

[73] Assignee: Novatech GmbH Siebe und Technologie Fur Papier, Reutlingen, Germany

[21] Appl. No.: 149,726

[22] Filed: Nov. 10, 1993

[30] Foreign Application Priority Data

Nov. 12, 1992 [DE] Germany ..... 9215427[U]

[51] Int. Cl.[6] ..... D03D 3/00; D03D 3/04

[52] U.S. Cl. ..... 139/85; 139/65; 139/383 AA

[58] Field of Search ..... 139/86, 85, 65, 383 AA

[56] References Cited

U.S. PATENT DOCUMENTS

| | | | |
|---|---|---|---|
| 4,057,084 | 11/1977 | Muller . | |
| 4,410,015 | 10/1983 | Koller et al. . | |
| 4,513,789 | 4/1985 | Bowen, Jr. | 139/85 |
| 4,581,794 | 4/1986 | Oldroyd et al. . | |
| 5,183,081 | 2/1993 | Kuster et al. | 139/85 X |

FOREIGN PATENT DOCUMENTS

| | | |
|---|---|---|
| 0043441 | 6/1981 | European Pat. Off. . |
| 2314279 | 11/1975 | France . |
| 425260 | 12/1924 | Germany . |
| 704153 | 2/1941 | Germany . |
| 3025909 | 2/1982 | Germany . |

*Primary Examiner*—Andrew M. Falik

*Attorney, Agent, or Firm*—Sughrue, Mion, Zinn, Macpeak & Seas

[57] ABSTRACT

A seam-weaving machine for the production of a continuous plastics woven fabric by a woven seam with a Jacquard machine (1) for the formation of the weaving shed. The Jacquard machine (1) is arranged underneath the weaving shed (11) and the harness cords (8) are drawn back by tension springs (15) secured above the weaving shed (11). The Jacquard machine (1) is so arranged that the harness cords (8) emerge downwardly from the Jacquard machine and are deflected upwardly through the weaving shed (11) to the tension springs (15).

4 Claims, 1 Drawing Sheet

COMPACT JACQUARD TYPE SEAM-WEAVING MACHINE

BACKGROUND OF THE INVENTION

The invention relates to a seam-weaving machine for making a plastics woven fabric endless by means of a woven seam. To form the weaving shed, the seam-weaving machine has a Jacquard machine, this being arranged underneath the weaving shed and the harness cords being drawn back by tension springs secured above the weaving shed.

Industrial plastics woven fabrics for uses in which a regular surface structure of the woven fabric is required, especially flat-woven paper-forming fabrics made from plastics mono-filaments, are made endless by a woven seam. To produce a woven seam, the warp threads are exposed to a length of e.g. 15 cm at the woven fabric ends which are to be joined to each other, the weft threads in this zone being removed. The woven seam, in which the original weave binding is exactly reproduced, is then formed from these warp thread fringes and the weft threads removed from a cut-off piece of woven fabric. An auxiliary weaving shed or seam-weaving shed is spread out from the removed weft threads, in which the removed weft threads function as auxiliary warp threads. The warp thread fringes projecting from the one woven fabric end and from the other woven fabric end are then inserted alternately into this seam-weaving shed as auxiliary weft threads.

The warp thread fringes, aligning with each other, of the one woven fabric end and of the other woven fabric end are in each case woven in only up to the so-called splice point, at which they are then guided out of the woven fabric and later cut off. The splice points are offset within the woven seam according to a specific pattern, which is of great significance for the tensile strength and quality of the woven seam. Jacquard machines are therefore particularly suitable for the formation of a seam-weaving shed with programmed splice points and the use of a Jacquard machine to produce a woven seam in known from U.S. Pat. No. 4,410,015 granted Oct. 18, 1983. The Jacquard machine is arranged in the usual manner above the seam-weaving shed, so that the harness cords emerging on the underside of the Jacquard machine can be guided on a straight path through the seam-weaving shed. The harness cords are drawn downwards by weights secured to the harness cords underneath the seam-weaving shed.

As is known from DE-C-704 153, the overall height of a weaving machine can be reduced by so designing the Jacquard machine that the harness cords are guided out at the upper side and then arranging the Jacquard machine underneath the weaving shed. Secured above the weaving shed is a tension spring grille in which are suspended tension springs which draws the harness cords back upwards. The use of return springs instead of weights also has the advantage that the operating speed of the Jacquard machine can be increased. Such an upside-down arrangement of a Jacquard machine in the manufacture of a woven seam for the production of a continuous paper-forming fabric is known from U.S. Pat. No. 4,581,794 granted Apr. 15, 1986. This type of arrangement of a Jacquard machine is also generally known in belt-weaving machines. However, these are special cases. As a rule, Jacquard machines are still arranged above the weaving shed.

SUMMARY OF THE INVENTION

The object of the invention is to use the higher efficiency and the greater product range of conventional Jacquard machines with harness cords guided out downwards for the manufacture of woven seams to produce continuous plastics woven fabrics and in the process establish the arrangement in such a way that, overall, the design of the seam-weaving machine is as compact as possible.

According to the invention, this object is achieved in that a Jacquard machine of conventional design, i.e. with harness cords guided out downwards, is arranged slightly offset underneath the weaving shed and the harness cords which are guided out downwards are deflected upwards, guided to the eyelets and secured to a grille above the latter by return springs or the like.

It was surprisingly shown that the deflection of the harness cords by a total of 180° does not substantially impair the function of the Jacquard machine. As a result, the possibility arises of also using double-lift open-shed Jacquard machines with a high operating speed in which the change of shed takes place much more quickly than with standard Jacquard machines.

The harness cords guided out from the Jacquard machine are preferably first deflected into a horizontal path by deflecting rollers and then deflected vertically upwards out of the horizontal path by several comber boards offset at an angel relative to each other, so that they can be guided upwards to the seam-weaving shed laterally past the Jacquard machine at a small distance. Above the seam-weaving shed, they are secured to return springs e.g. elastic cords such as Lycra counter-strings.

This type of arrangement of Jacquard machines and of the guiding of the harness cords makes possible e.g. the use of a standard commercial electronically controlled double-lift open-shed Jacquard machine.

An embodiment of the invention is explained below with reference to the drawings.

DETAILED DESCRIPTION OF THE INVENTION

Figure 1:
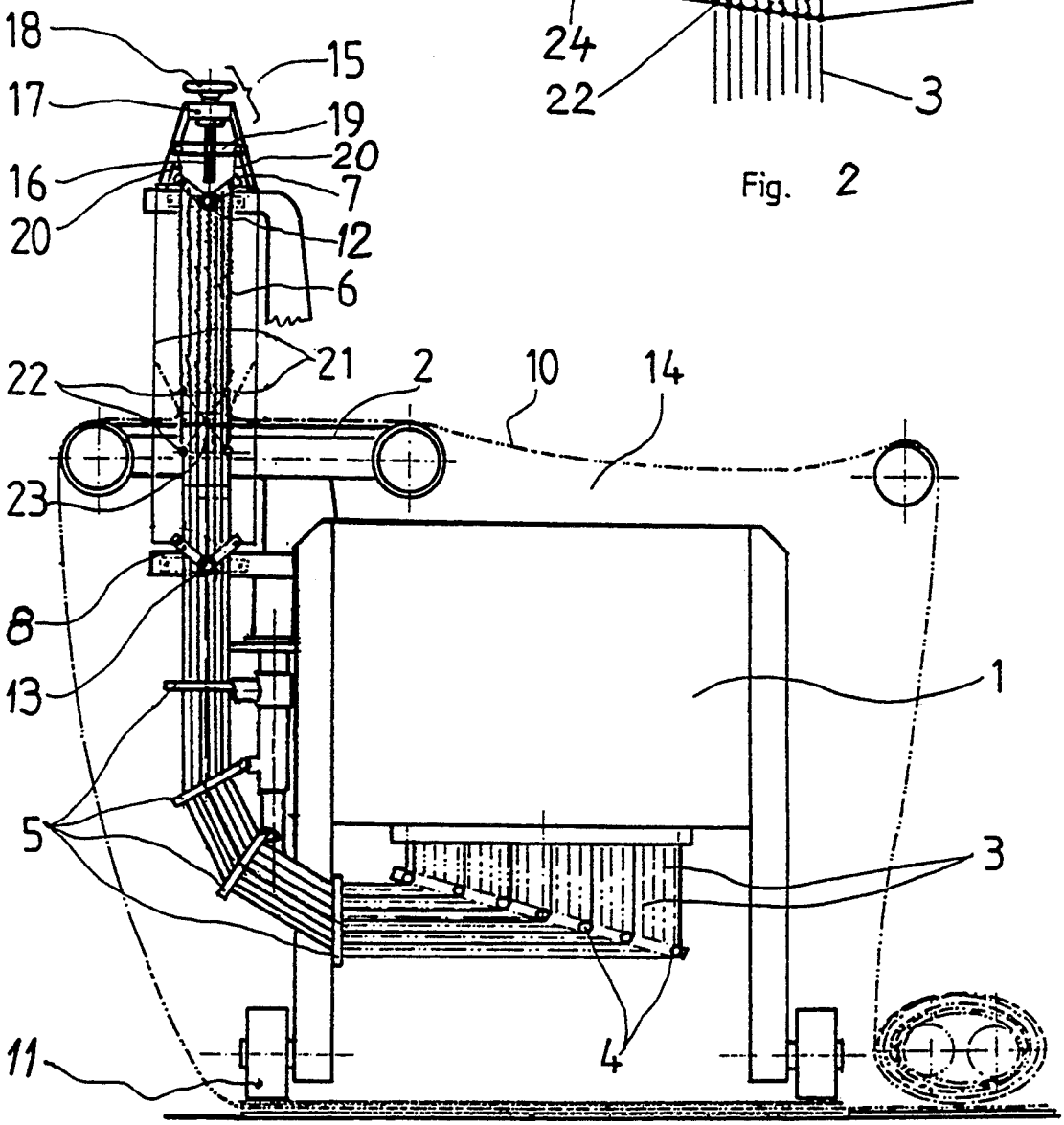
FIG. 1 is a front elevational view of a seam-weaving machine, partly in section, perpendicular to the direction of the auxiliary warp threads of the seam-weaving shed.

FIG. 1 shows in section the arrangement of the Jacquard machine 1 inside a seam-weaving machine for making an endless paper-forming fabric 2 endless. The paper-forming fabric 2 is guided round the Jacquard machine, so that the two woven fabric ends 3, 4 to be joined lie opposite each other at a distance of e.g. 10 cm. The woven fabric ends are clamped fast on stationary tracks 5, 6. The Jacquard machine 1 is located inside the paper-forming fabric 2 and is moved on rollers 7 on a guide path according to the progress of the woven seam.

The harness cords 8 guided out downwards are deflected into a horizontal path by deflecting rollers 9. Each harness cord 8 is provided with its own deflecting rollers, 9, the rollers 9 for the harness cords 8 being arranged in a row on a common axis. The deflecting rollers 9 are arranged in a plane 10 lying at a small angle to a horizontal plane, so that the harness width is substantially reduced by the deflection at the same time.

The harness' cords 8 are then guided upwards to the weaving shed 11 laterally alongside the Jacquard machine. The deflection out of the horizontal path vertically upwards takes place through a total of four comber boards 12 in order to keep the deflection angle small at every comber board 12, the first comber board 12 being arranged perpendicular and each of the succeeding comber boards being tilted at an angle of about 30° relative to the preceding one, so that the last comber board lies horizontal. This type of deflection requires little space and does not alter the harness width. Arranged immediately below the weaving shed 11 is a harness board 13 which consists of two halves connected by a hinged joint and which, in conjunction with a tension spring grille 14 divided in the same way which is arranged above the weaving shed 11, makes possible a matching of the distance between the harness cords 8 to the distance between the auxiliary warp threads inside the weaving shed 11. This harness guide is described in a copending U.S. Patent application "Adjustable harness guide for the Jacquard machine of a seam-weaving machine"filed simultaneously by the same applicant (our reference Q-33400). Ser. No. 08/149,957.

Figure 2:
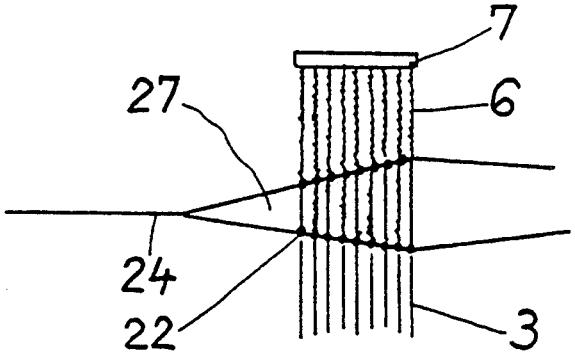
FIG. 2 is a detailed side elevational view of the weaving shed.

FIG. 2 shows the seam-weaving shed from the side. Secured to the tension spring grille 14, shown only diagrammatically, are the upper ends of tension springs 15 to whose lower ends eyelets 16 are secured. The harness cords 8 are guided from below to the eyelets 16, so that the harness cords 8 work against the return springs 15 and the seam-weaving shed 11 is spread out through the eyelets 16 arranged in between.

While the invention has been particularly shown and described with reference to preferred embodiments thereof, it will be understood by those in the art that the foregoing and other changes in form and details may be made therein without departing from the spirit and scope of the invention.

What is claimed is:

1. A seam-weaving machine for making a plastics woven fabric endless by means of a woven seam comprising a Jacquard machine for the formation of a weaving shed, the Jacquard machine being arranged slightly offset underneath the weaving shed, tension springs secured in said machine above the weaving shed and connected to a plurality of harness cords extending vertically downwardly from the Jacquard machine and guide means carried by said machine for deflecting the harness cords 180° prior to passage through the weaving shed to the tension springs.

2. A seam-weaving machine according to claim 1, wherein said guide means includes deflecting rollers for initially deflecting the harness cords emerging vertically downwardly from the Jacquard machine into a horizontal path.

3. A seam-weaving machine according to claim 2, wherein said guide means further include a plurality of comber boards offset at an angle relative to each other for sequentially deflecting said harness cords from said horizontal path vertically upwards to said springs.

4. A seam-weaving machine according to claim 1, wherein the Jacquard machine is a double-lift open-shed Jacquard machine.

* * * * *